US005916725A

United States Patent [19]

Patel et al.

[11] Patent Number: 5,916,725

[45] Date of Patent: Jun. 29, 1999

[54] SURFACTANT FREE TONER PROCESSES

[75] Inventors: Raj D. Patel, Oakville; Walter Mychajlowskij, Mississauga; Daniel A. Foucher, Toronto; Guerino G. Sacripante, Oakville; Beng S. Ong, Mississauga, all of Canada

[73] Assignee: Xerox Corporation, Stamford, Conn.

[21] Appl. No.: 09/006,299

[22] Filed: Jan. 13, 1998

[51] Int. Cl.[6] ..... G03G 9/087

[52] U.S. Cl. ..... 430/137; 523/335

[58] Field of Search ..... 430/137; 523/334, 523/335

[56] References Cited

U.S. PATENT DOCUMENTS

| | | | |
|---|---|---|---|
| 4,137,188 | 1/1979 | Uetake et al. | 252/62.1 P |
| 4,558,108 | 12/1985 | Alexandru et al. | 526/340 |
| 4,797,339 | 1/1989 | Maruyama et al. | 430/109 |
| 4,983,488 | 1/1991 | Tan et al. | 430/137 |
| 4,996,127 | 2/1991 | Hasegawa et al. | 430/109 |
| 5,066,560 | 11/1991 | Tan et al. | 430/137 |
| 5,278,020 | 1/1994 | Grushkin et al. | 430/137 |
| 5,290,654 | 3/1994 | Sacripante et al. | 430/137 |
| 5,308,734 | 5/1994 | Sacripante et al. | 430/137 |
| 5,344,738 | 9/1994 | Kmiecik-Lawrynowicz et al. | 430/137 |
| 5,346,797 | 9/1994 | Kmiecik-Lawrynowicz et al. | 430/137 |
| 5,348,832 | 9/1994 | Sacripante et al. | 430/109 |
| 5,364,729 | 11/1994 | Kmiecik-Lawrynowicz et al. | 430/137 |
| 5,366,841 | 11/1994 | Patel et al. | 430/137 |
| 5,370,963 | 12/1994 | Patel et al. | 430/137 |
| 5,403,693 | 4/1995 | Patel et al. | 430/137 |
| 5,405,728 | 4/1995 | Hopper et al. | 430/137 |
| 5,418,108 | 5/1995 | Kmiecik-Lawrynowicz et al. | 430/137 |
| 5,496,676 | 3/1996 | Croucher et al. | 430/137 |
| 5,501,935 | 3/1996 | Patel et al. | 430/137 |
| 5,527,658 | 6/1996 | Hopper et al. | 430/107 |
| 5,585,215 | 12/1996 | Ong et al. | 430/137 |
| 5,593,807 | 1/1997 | Sacripante et al. | 430/137 |
| 5,648,193 | 7/1997 | Patel et al. | 430/137 |
| 5,650,255 | 7/1997 | Ng et al. | 430/137 |
| 5,650,256 | 7/1997 | Veregin et al. | 430/137 |
| 5,658,704 | 8/1997 | Patel et al. | 430/137 |
| 5,660,965 | 8/1997 | Mychajlowskij et al. | 430/137 |

*Primary Examiner*—John Goodrow
*Attorney, Agent, or Firm*—E. O. Palazzo

[57] ABSTRACT

A process for the preparation of toner comprising mixing an amine, an emulsion latex containing sulfonated polyester resin, and a colorant dispersion, heating the resulting mixture, and optionally cooling.

32 Claims, No Drawings

SURFACTANT FREE TONER PROCESSES

PATENT AND PENDING APPLICATIONS

The following copending applications, the disclosures of which are totally incorporated herein by reference, are being filed concurrently herewith.

U.S. Pat. No. 5,840,462 discloses a toner process wherein a colorant is flushed into a sulfonated polyester, followed by the addition of an organic soluble dye and an alkali halide solution.

U.S. Pat. No. 5,853,944 discloses a toner process with a first aggregation of sulfonated polyester, and thereafter, a second aggregation with a colorant dispersion and an alkali halide.

U.S. Ser. No. 09/006640 discloses a toner process wherein a latex emulsion and a colorant dispersion are mixed in the presence of an organic complexing agent or compound, and wherein the latex can contain a sodio sulfonated polyester resin.

U.S. Ser. No. 09/006521 discloses an emulsion/aggregation/fusing process for the preparation of a toner containing a resin derived from the polymerization of styrene butadiene, acrylonitrile, and acrylic acid.

U.S. Ser. No. 09/006553 discloses a toner process wherein there is mixed an emulsion latex, a colorant dispersion, and a monocationic salt, and wherein the resulting mixture possesses an ionic strength of about 0.001 molar to about 5 molar.

U.S. Pat. No. 5,869,215 discloses a toner process by blending an aqueous colorant dispersion with a latex blend containing a linear polymer and soft crosslinked polymer particles.

U.S. Pat. No. 5,869,216 discloses a toner process wherein there is mixed an aqueous colorant dispersion and an emulsion latex, followed by filtering, and redispersing the toner formed in water at a pH of above about 7 and contacting the resulting mixture with a metal halide or salt and then with a mixture of an alkaline base and a salicylic acid, a catechol, or mixtures thereof.

The appropriate components and processes of the above copending applications, such as the sulfonated polyesters, may be selected for the invention of the present application in embodiments thereof.

Illustrated in U.S. Pat. No. 5,593,807, the disclosure of which is totally incorporated herein by reference, is a process for the preparation of toner compositions comprising, for example, preparing an emulsion latex comprised of sodio sulfonated polyester resin particles of about 5 to about 500 nanometers in size diameter by heating the resin in water at a temperature of, for example, from about 65° C. to about 90° C.; preparing a colorant dispersion by dispersing in water from about 10 to about 25 weight percent of a sodio sulfonated polyester and from about 1 to about 5 weight percent of colorant; adding with shearing the colorant dispersion to the latex mixture, followed by the addition of an alkali metal halide, such as calcium chloride until aggregation results as indicated, for example, by an increase in the latex viscosity of from about 2 centipoise to about 100 centipoise; heating the resulting mixture at a temperature of from about 45° C. to about 80° C. thereby causing further aggregation and enabling coalescence, resulting in toner particles of from about 4 to about 9 microns in volume average diameter and with a geometric distribution of less than about 1.3; and optionally cooling the product mixture to about 25° C., followed by washing and drying. The process and toner of this patent discloses a gloss of up to about 70, which is essentially a matte finish. With the present invention, when an amine is selected in place of the alkali halide a toner that enables high gloss images is achievable, for example a gloss of over 70, and more specifically, from about 80 to about 95, and yet more specifically, at least about 80 to 85. The use of alkali metal can result in a final toner resin which evidences some crosslinking or elastic reinforcement primarily since the metal salt functions as a crosslinked site between the sulfonate groups contained on the polyester resin causing an increase in viscosity and a decrease, or loss of low gloss characteristics.

The appropriate components and processes of the U.S. Pat. No. 5,593,807 patent, such as the sulfonated polyesters, may be selected for the invention of the present application in embodiments thereof.

BACKGROUND OF THE INVENTION

The present invention is generally directed to toner processes, and more specifically, to aggregation and coalescence processes for the preparation of toner compositions. In embodiments, the present invention is directed to the economical chemical in situ preparation of toners without the need for the use of known toner pulverization and/or classification methods, and wherein in embodiments toner compositions with a volume average diameter of from about 1 to about 25, and preferably from 1 to about 10 microns, and narrow GSD of, for example, from about 1.14 to about 1.26 as measured on the Coulter Counter can be obtained. The resulting toners can be selected for known electrophotographic imaging, printing processes including color processes, digital processes, and lithography.

In reprographic technologies, such as xerographic and ionographic devices, toners with volume average diameter particle sizes of from about 9 microns to about 20 microns are effectively utilized. Moreover, in a number of xerographic technologies, such as the high volume Xerox Corporation 5090 copier-duplicator, high resolution characteristics and low image noise are highly desired, and can be attained by, for example, utilizing the small sized toners of the present invention with, for example, a volume average particle of from about 2 to about 11 microns and preferably less than about 7 microns, and with narrow geometric size distribution (GSD) of from about 1.16 to about 1.3. Additionally, in xerographic systems wherein process color is utilized, such as pictorial color applications, small particle size colored toners, preferably of from about 3 to about 9 microns, are highly desired to avoid paper curling. Paper curling is especially observed in pictorial or process color applications wherein three to four layers of toners are transferred and fused onto paper. During the fusing, moisture is driven off from the paper due to the high fusing temperatures of from about 130° C. to about 160° C. applied to the paper from the fuser. Where only one layer of toner is present, such as in black or in highlight xerographic applications, the amount of moisture driven off during fusing can be reabsorbed proportionally by paper and the resulting print remains relatively flat with minimal curl. In pictorial color process applications wherein three to four colored toner layers are present, a thicker toner plastic level present after the fusing step can inhibit the paper from sufficiently absorbing the moisture lost during the fusing step, and image paper curling results. These and other disadvantages and problems are avoided or minimized with the toners and processes of the present invention.

Also, it is preferable to select for the development of color images toners with small particle sizes, such as from about 1 to 7 microns in volume average diameter, and with higher pigment loading, such as from about 5 to about 12 percent by weight of toner, and such that the mass of toner layers deposited onto a substrate like paper is reduced to enable obtaining excellent image quality, and whereby a thinner plastic toner layer forms on paper after fusing, thereby minimizing or avoiding paper curling. Toners prepared in accordance with the present invention enable in embodiments the use of lower image fusing temperatures, such as from about 120° C. to about 150° C., thereby avoiding or minimizing paper curl. Lower fusing temperatures minimize the loss of moisture from paper, thereby reducing or eliminating paper curl. Furthermore, in process color applications, and especially in pictorial color applications, toner to paper gloss matching is highly desirable. Gloss matching is referred to as matching the gloss of the toner image to the gloss of the paper. For example, when a low gloss image of preferably from about 1 to about 30 gloss is desired, low gloss paper is utilized, such as from about 1 to about 30 gloss units as measured by the Gardner Gloss metering unit, and which after image formation with small particle size toners, preferably of from about 3 to about 5 microns and fixing thereafter, results in a low gloss toner image of from about 1 to about 30 gloss units as measured by the Gardner Gloss metering unit. Alternatively, when higher image gloss is desired, such as from about 30 to about 60 gloss units as measured by the Gardner Gloss metering unit, higher gloss paper is utilized, such as from about 30 to about 60 gloss units, and which after image formation with small particle size toners of the present invention of preferably from about 3 to about 5 microns, and fixing thereafter results in a higher gloss toner image of from about 30 to about 60 gloss units as measured by the Gardner Gloss metering unit. The aforementioned toner to paper matching can be attained with small particle size toners, such as less than about 7 microns and preferably less than about 5 microns, such as from about 1 to about 4 microns, whereby the pile height of the toner layer or layers is considered low and acceptable.

PRIOR ART

Numerous processes are known for the preparation of toners, such as, for example, conventional processes wherein a resin is melt kneaded or extruded with a colorant like a pigment, micronized and pulverized to provide toner particles with a volume average particle diameter of from about 9 microns to about 20 microns and with broad geometric size distribution of from about 1.4 to about 1.7. In these processes, it is usually necessary to subject the toners to a classification procedure such that the geometric size distribution of from about 1.2 to about 1.4 is attained. Also, in the aforementioned conventional process, low toner yields after classifications may be obtained. Generally, during the preparation of toners with average particle size diameters of from about 11 microns to about 15 microns, toner yields range from about 70 percent to about 85 percent after classification. Additionally, during the preparation of smaller sized toners with particle sizes of from about 7 microns to about 11 microns, lower toner yields are obtained in some instances after classification, and which yields are from about 50 percent to about 70 percent. With the processes of the present invention in embodiments, small average particle sizes of, for example, from about 3 microns to about 9 microns, and preferably 5 microns are attained without resorting to classification processes, and wherein narrow geometric size distributions are attained, such as from about 1.16 to about 1.30, and preferably from about 1.16 to about 1.25. High toner yields are also attained, such as from about 90 percent to about 98 percent, in embodiments of the present invention. Further, with the toner particle preparation process of the present invention in embodiments, small particle size toners of from about 3 microns to about 7 microns can be economically prepared in high yields, such as from about 90 percent to about 98 percent by weight based on the weight of all the toner material ingredients, such as toner resin and pigment.

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by emulsion polymerization methods, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. The disadvantage, for example, of poor GSD requires classification resulting in low toner yields, reference for example U.S. Pat. No. 4,797,339, wherein there is disclosed a process for the preparation of toners by resin emulsion polymerization, wherein similar to the '127 patent certain polar resins are selected; and U.S. Pat. No. 4,558,108, wherein there is disclosed a process for the preparation of a copolymer of styrene and butadiene by specific suspension polymerization.

In U.S. Pat. No. 5,290,654, the disclosure of which is totally incorporated herein by reference, there is illustrated a process for the preparation of toners comprised of dispersing a polymer solution comprised of an organic solvent and a polyester, and homogenizing and heating the mixture to remove the solvent and thereby form toner composites.

Emulsion/aggregation/coalescing processes for the preparation of toners are illustrated in a number of Xerox patents, the disclosures of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; 5,650,256 and 5,501,935 (spherical toners).

A number of the appropriate components of the copending applications and above Xerox Corporation patents, such as the colorants, pigments, resins, charge additives, and the like, may be selected for the processes of the present invention in embodiments thereof.

SUMMARY OF THE INVENTION

It is an feature of the present invention to provide toner processes with many of the advantages illustrated herein.

In embodiments, the present invention is directed to a process with reduced surfactant amounts, or wherein surfactants can be eliminated and which process comprises forming a latex of a polyester, such as a sodium sulfonated polyester resin in water, mixing the latex with a colorant, especially pigment dispersion, and wherein the colorant particles are stabilized by the addition of submicron sulfonated polyester particles which are in the size range of, for example, from about 50 to about 200 nanometers, or more specifically, about 100 to about 150 nanometers, and which dispersion contains an amine organic molecule to form aggregates, and thereafter, heating the formed aggregates to enable the generation of coalesced toner particles. The enablement of aggregation/coalescence in a single sequence is thus permitted. The polyester resin selected preferably contains sulfonated groups thereby rendering them dissipatable, that is they form spontaneous emulsions in water without the use of organic solvents, above, or equal to about the glass transition temperature, Tg, of the resin, such as the sulfonated polyester. The process of the present invention can be considered a surfactant free chemical method for the preparation of toners wherein sulfopolyester resin particles are aggregated together with colorant particles, which colorant particles are stabilized by submicron sulfonated polyester particles, and wherein there are selected organic molecules such as aliphatic amines, and which processes involve high shearing conditions followed by heating for coalescence, and wherein during the heating no surfactants are utilized. Heating the mixture about above or in embodiments equal to the resin Tg generates toner particles with, for example, a volume average diameter of from about 1 to about 25 and preferably 2 to 10 microns as measured by known means, such as a Coulter Counter. It is believed that during the heating stage, the resin and colorant particles aggregate and coalesce together in one single step to form the composite toner particle. Furthermore, the aggregation and coalescence is such that a continuous growth in particle size is observed when heated at, for example, the optimum aggregation temperature, the optimum temperature being in the range of, for example, from about 40° C. to about 60° C. and preferably in the range of about 45° C. to about 55° C., and which heating is accomplished in the presence of a coagulating agent of an organic amine. Also, with the present invention there is enabled a continuous process and the continuous growth of submicron polyester particles from the about 20 to 30 nanometers range to toner sized particles of from about 3 to about 20 microns in volume average diameter as determined by known methods, such as a Coulter Counter, and which processes can select controlled increases in the ionic strength of the mixture selected.

The present invention relates to simple and economical processes for the direct preparation of black and colored toner compositions with, for example, excellent colorant, such as pigment dispersion, and wherein the colorant dispersion is comprised of submicron, for example less than about 1 micron, in diameter particles stabilized by submicron sulfonated polyester particles, and wherein there results toners with narrow GSD, and wherein the coagulant is a small organic molecule, such as Dytek or a similar suitable amine; in situ surfactant free processes for black and colored toner compositions by an emulsion aggregation process, and wherein a sulfonated polyester is selected as the resin and dissipated in water resulting in submicron polyester particles, reference the sulfonated polyesters of copending patent application U.S. Ser. No. 221,595, the disclosure of which is totally incorporated herein by reference; and the preparation of a toner with sulfonated polyester, which is easily dissipatable in water resulting in submicron particles to which the pigments, such as red, green, blue, yellow, and the like, and more specifically, HELIOGEN BLUE™ or HOSTAPERM PINK™ wet cakes, are introduced, and wherein the mixture resulting is further ground down by either attrition or other mechanical dispersion methods, such as an ultimizer, or a microfluidizer, resulting in a fine dispersion of pigment stabilized by submicron sulfonated polyester particles. Additionally, the submicron sulfonated resin particles used to stabilize the pigment particles can possess the same molecular weight, similar glass transaction and the same, or similar number of sulfonation groups properties as that of the submicron latex resin, and wherein the toner resulting possesses an average particle volume diameter of from between about 1 to about 20 microns, preferably from about 1 to about 10 microns, and more preferably 2 to 9 microns in volume average diameter, and with a narrow GSD of from, for example, about 1.12 to about 1.35, and preferably from about 1.14 to about 1.26 as measured by a Coulter Counter.

The process of the present invention relates to toner compositions with certain effective particle sizes by controlling the temperature of the aggregation, and which processes comprise stirring and heating about below the resin glass transition temperature (Tg), wherein a continuous growth in particle size is observed at a certain temperature, and wherein this temperature is, for example, from about 45° C. to about 60° C. or from about 2° C. to about 8° C. below the latex resin Tg; wherein after fixing to paper substrates there results images with a high gloss of from in excess of about 70, and more specifically, from about 80 to about 95 GGU (Gardner Gloss Units) as measured by Gardner Gloss meter matching of toner and paper wherein there are enabled composite toners comprised of polymeric resin with pigment and optional charge control agent in high yields of from about 90 percent to about 100 percent by weight of toner without resorting to classification, and wherein surfactants are avoided; and wherein there is accomplished the dissipating of a polar charged sodium sulfonated polyester resin in water with a homogenizer at about 40° C. to about 90° C. resulting in submicron polyester particles in the size range of from about 50 to about 150 nanometers to form an emulsion latex, followed by aggregation coalescence of the submicron emulsion particles, and submicron pigment particles which are stabilized by the submicron sulfonated polyester particles, and wherein the aggregation is accomplished with an organic small molecule, such as Dytek, as a coagulant, and wherein the aggregation/coalescence is conducted at a temperature of about 2 to about 8 degrees below the resin Tg; and wherein the toner particle growth is terminated by quenching, or cooling the reactor contents; wherein there is prepared a linear dissipatable sulfonated polyester resin by a polycondensation process, wherein the synthesized resin is easily dispersed in warm water at temperatures of about 5 degrees above the resin Tg resulting in submicron particles in the diameter size range of from about 30 to about 250 nanometers, and preferably in the range of from about 50 to about 200 nanometers, and with a solids concentration of from about 5 to about 50 and preferably about 15 to about 30 weight percent of the aqueous phase, and wherein the solids are comprised of sulfonated resin particles, and thereafter adding colorant in the form of a wet cake and then further grinding down by mechanical means, such as by attrition, microfluidization or ultimization, resulting in colorant particles stabilized by submicron sulfonated polyester particles.

Toner compositions with low fusing temperatures of from about 110° C. to about 150° C. and with excellent blocking characteristics at from about 50° C. to about 60° C. can be obtained with the processes of the present invention in embodiments thereof, and which toners enable high gloss images.

More specifically, the present invention comprises initially attaining or generating a colorant dispersion, for example, by dispersing an aqueous mixture of a colorant, such as a pigment or pigments, such as carbon black like REGAL 330® obtained from Cabot Corporation, phthalocyanine, quinacridone or RHODAMINE BM™, and generally cyan, magenta, yellow, or mixtures thereof, and the like to enable aggregation/coalescence of submicron resin and resin stabilized pigment particles, and to generate toner size particles in the size range of from about 1 to about 20, more specifically from about 3 to about 10 microns and preferably in the range of from about 4 to about 9 microns, and with a narrow particle size distribution, which is in the range of, for example, from about 1.15 to about 1.25, and which aggregation is accomplished about 2 to about 5 degrees below the Tg of the sulfonated resin; or a process for preparing a colorant, especially pigment dispersion, such as HELIOGEN BLUE™, in which the pigment, preferably submicron in size, for example from about 0.05 to about 0.2 micron, is stabilized by submicron sulfonated polyester particles, which particles are in the size range of from about 50 to about 150 nanometers, in volume average diameter as preferably measured on the Nicomp particle sizer, and wherein the sulfonated polyester resin is slowly added, for example, over a period of about 30 minutes into hot water, which water is at a temperature of, for example, about 70° C. to 75° C., followed by stirring until the resin is fully dispersed resulting in submicron particles suitable for use as a colorant like pigment, or dye stabilizer. Shearing this dispersion with a latex of suspended sulfonated polyester resin particles preferably in the size range of from about 50 to about 300 nanometers enables the formation of aggregates. Thereafter, the mixture resulting is aggregated with an amine, such as an aliphatic amine resulting in a aggregates comprised of the resin and colorant particles. The speed at which the toner size aggregates are formed is primarily controlled by the temperature and by the amount of small organic molecules, such as Dytek selected, resulting in toner size particles in the range of from about 1 to about 20 microns and preferably in the range of from about 2 to about 10 microns, with a GSD of about 1.1 to about 1.4 and preferably about 1.14 to about 1.26. The aforementioned toners are especially useful for the development of colored images with excellent line and solid resolution, and wherein substantially no background deposits are present. The present invention also resides in processes for the preparation of a surfactant free chemical toners, wherein the washing of the toner particles can be eliminated since no surfactant is utilized in the synthesis of the toner. Isolating, filtering and rinsing the toner particles with, for example, water is primarily for the removal of any salts that may have formed. Of importance to the present invention in embodiments is the absence of surfactant, and wherein the colorant, such as pigment, is stabilized by submicron sulfonated polyester particles.

The process of the present invention in embodiments comprises preparing an emulsion latex comprised of sodio sulfonated polyester resin particles of preferably less than about, or equal to about 0.1 micron in size diameter, and for example, from about 5 to about 500 nanometers, and in an amount of from about 1 to about 5 weight percent, by heating this resin in water at a temperature of for example, from about 45° C. to about 90° C.; adding a colorant like pigment dispersion comprised of colorant stabilized by submicron sulfonated polyester particles to the latex mixture comprised of water and sulfonated polyester resin particles, followed by the coagulant addition of an amine, and wherein the coagulant is selected in an amount of, for example, from about 0.5 to about 5 and preferably from about 1 to about 3 weight percent in water until a slight increase in viscosity of, for example, from about 2 centipoise to about 100 centipoise is observed; heating the resulting mixture below about the resin Tg, and more specifically, at a temperature of, for example, from about 45° C. to about 60° C. thereby causing aggregation and coalescence, and resulting in toner particles of from about 4 to about 9 microns in size with a geometric distribution of less than about 1.25, and optionally quenching the product mixture to, for example, about 25° C., followed by filtering to remove any salts that may have formed, and drying.

In embodiments, the present invention relates to a process for the preparation of toner compositions comprising preparing an emulsion latex comprised of sodio sulfonated polyester resin particles of from about 5 to about 500 nanometers in size diameter by heating the resin in water at a temperature of from about 65° C. to about 90° C.; adding a pigment dispersion, which pigment dispersion comprises submicron pigment particles in the size range of about 0.05 to about 0.6 micron (volume average diameter throughout), and preferably in the size range of about 0.06 to about 0.4 micron, stabilized by submicron sulfonated polyester particles in the size range of about 30 to about 350 nanometers and preferably in the size range of about 50 to about 300 nanometers to a latex mixture comprised of sulfonated polyester resin particles in water and with shearing, followed by the addition of the amine, such as Dytek, in water until a slight increase in the viscosity of from about 2 centipoise to about 100 centipoise is observed as measured by a Brookfield Viscosity meter; heating the resulting mixture at a temperature of from about 45° C. to about 60° C. thereby enabling aggregation and coalescence simultaneously, resulting in toner particles of from about 4 to about 15 microns in volume average diameter and with a geometric distribution of less than about 1.25; and optionally quenching, or cooling the product mixture to about 25° C., followed by filtering and drying; a surfactant free process for the preparation of toner compositions comprising preparing an emulsion latex comprised of sodio sulfonated polyester resin particles of less than 0.1 micron in size by heating the resin in water at a temperature of from about 15° C. to about 30° C. above its glass transition temperature; adding a pigment dispersion wherein the pigment dispersion comprises submicron pigment particles stabilized by submicron, for example from about 30 to about 120 nanometers in diameter, sulfonated polyester particles to a latex mixture comprised of sulfonated polyester resin particles in water, and subsequently adding an amine in an amount of from about 1 to about 10, or more specifically, from about 1 to about 3 weight percent in water until gellation results as indicated by, for example, an increase in viscosity of from about 2 centipoise to about 100 centipoise; heating the resulting mixture below about the resin Tg at a temperature of from about 45° C. to about 60° C. thereby enabling aggregation and coalescence, and quenching the product mixture with water to about 25° C., followed by filtering and drying; and a process for the preparation of toner compositions comprising preparing an emulsion latex comprised of sodio sulfonated polyester resin particles by heating the particles in water; adding a pigment dispersion comprised of pigment admixed with and stabilized by submicron sulfonated polyester resin particles to the latex mixture, followed by the addition of an amine; and heating the resulting mixture thereby enabling simultaneous aggregation and coalescence, and wherein no surfactants are utilized at any stage of the toner synthesis, thereby rendering the process completely surfactant free.

Moreover, in a further embodiment of the present invention the use of the submicron polyester resin particles as a colorant stabilizer results in the colorant particles being tightly bound to the resin particles thereby providing stability, and when such dispersions are selected for the toner synthesis substantially no colorant bleeding in the aqueous phase results as is often observed with surfactant stabilized colorants, such as RED 81.3 RHODAMINE™ pigment.

Processes of the present invention include the preparation of toner comprising mixing an amine, an emulsion latex containing sulfonated polyester resin, and a colorant dispersion wherein the colorant is stabilized by sulfonated polyester resin particles, heating the resulting mixture and optionally cooling; a process wherein said latex contains water and suspended therein a sodio sulfonated polyester resin of from about 5 to about 500 nanometers in size diameter, wherein said colorant is stabilized by submicron sodio sulfonated polyester resin, and thereafter adding to the mixture an amine, and wherein cooling is accomplished; a process wherein the (i) sodio sulfonated polyester resin is prepared by heating this resin in water at a temperature of from about 65° C. to about 90° C.; (ii) thereafter adding the colorant dispersion, which colorant dispersion is stabilized by the submicron sodio sulfonated polyester resin particles, to the latex mixture with shearing, followed by the addition of an amine and water until there results an increase in the latex viscosity of from, for example, about 2 centipoise to about 100 centipoise, cooling, and heating the resulting mixture at a temperature of from about 45° C. to about 80° C. thereby enabling continuous aggregation and coalescence of particles of resin and colorant, resulting in toner particles of from about 2 to about 20 microns in volume average diameter; and (iii) quenching, or cooling the product mixture to, for example, about 25° C. followed by isolation with filtration and drying; a process wherein the colorant dispersion contains a pigment, and wherein the pigment is stabilized by said submicron sodio sulfonated polyester resin, and which resin is in the size range of from about 50 to about 250 nanometers, and wherein said shearing is completed by homogenizing at from about 1,000 revolutions per minute to about 10,000 revolutions per minute, at a temperature of from about 25° C. to about 35° C., and for a duration of from about 1 minute to about 120 minutes; a process wherein the dispersion of (ii) is accomplished by microfluidization in a microfluidizer, or in nanojet for a duration of from about 1 minute to about 120 minutes; a process wherein shearing or homogenization is accomplished by homogenizing at from about 1,000 revolutions per minute to about 10,000 revolutions per minute for a duration of from about 1 minute to about 120 minutes; a process wherein the latex resin is (i) a polyester of poly(1,2-propylene-sodio 5-sulfoisophthalate), poly(neopentylene-sodio 5-sulfoisophthalate), poly (diethylene-sodio 5-sulfoisophthalate), copoly(1,2-propylene-sodio 5-sulfoisophthalate)-copoly-(1,2-propylene-terephthalate phthalate), copoly(1,2-propylene-diethylene sodio 5-sulfoisophthalate)-copoly-(1,2-propylene-diethylene-terephthalatephthalate), copoly (ethylene-neopentylene-sodio 5-sulfoisophthalate)-copoly-(ethylene-neopentylene-terephthalate-phthalate), or copoly (propoxylated bisphenol A)-copoly-(propoxylated bisphenol A-sodio 5-sulfoisophthalate; a process wherein the resin of (i) is a polyester of poly(1,2-propylene-sodio 5-sulfoisophthalate), poly(neopentylene-sodio 5-sulfoisophthalate), poly(diethylene-sodio 5-sulfoisophthalate), copoly(1,2-propylene-sodio 5-sulfoisophthalate)-copoly-(1,2-propylene-terephthalatephthalate), copoly(1,2-propylene-diethylene sodio 5-sulfoisophthalate)-copoly-(1,2-propylene-diethylene-terephthalatephthalate), copoly(ethylene-neopentylene-sodio 5-sulfoisophthalate)-copoly-(ethylene-neopentylene-terephthalatephthalate), or copoly (propoxylated bisphenol A)-copoly-(propoxylated bisphenol A-sodio 5-sulfoisophthalate; a process wherein the colorant is carbon black, cyan, yellow, magenta, and mixtures thereof; a process wherein the latex resin is from about 0.01 to about 0.2 micron in volume average diameter, and the colorant particles are from about 0.01 to about 500 nanometers in volume average diameter; a process wherein the toner particles isolated are from about 2 to about 15 microns in volume average diameter, and the geometric size distribution thereof is from about 1.15 to about 1.35; a process wherein there is added to the surface of the formed toner metal salts, metal salts of fatty acids, silicas, metal oxides, or mixtures thereof, each in an amount of from about 0.1 to about 10 weight percent of the obtained toner particles; a process wherein the toner obtained after cooling is from about 3 to about 15 microns in volume average diameter, and the geometric size distribution thereof is from about 1.15 to about 1.30; a process wherein the latex resin Tg is from about 50° C. to about 65° C.; a surfactant free process for the preparation of toner comprising providing, or generating an emulsion latex comprised of sodio sulfonated polyester resin particles of less than about 0.2 micron in size diameter by heating said resin in water at a temperature of from about 15° C. to about 30° C. above the resin glass transition temperature; mixing with a colorant dispersion wherein the dispersion is comprised of colorant and submicron sodio sulfonated resin particles of a size less than about 0.2 micron and which resin particles are coated on the colorant; followed by the addition of an amine of from about 1 to about 2 weight percent in water until a slight increase in viscosity of, for example, from about 2 centipoise to about 100 centipoise results; heating the resulting mixture at a temperature of from about 45° C. to about 80° C. thereby enabling aggregation and coalescence of particles of resin and colorant in a continuous manner, resulting in toner particles of from about 2 to about 20 microns in volume average diameter, and thereafter cooling the product mixture, isolating the toner, followed by washing and drying; a process for the preparation of toner comprising mixing an emulsion latex comprised of sodio sulfonated polyester resin particles and a colorant dispersion, and wherein the colorant is of submicron size and is stabilized by submicron resin particles, followed by the addition of an amine; and heating the resulting mixture thereby causing aggregation and coalescence; a process wherein subsequent to coalescence the toner product mixture is cooled, followed by isolation, washing and drying; a process wherein the toner product mixture is cooled to about 25° C.; a process wherein in (ii) the colorant dispersion is generated with a microfluidizer at from about 75° C. to about 85° C. for a duration of from about 1 hour to about 3 hours, and wherein subsequent to (iv) the toner compositions or particles resulting are (v) cooled to about 25° C., followed by washing and drying; a process wherein the amine is present in an amount of about 1 to about 10 weight percent based on the total solids; a process wherein the amine is triethylamine, tripropylamine, 2-methyl-1,5-pentanediamine, 1,4-diaminobutane, 1,8-diaminooctane, 1,5-diaminopentane, 1,6-diaminohexane, 17-diaminoheptane, 1,3-diaminopropane, 1,2-diaminopropane, or 1,3-diamino-2-hydroxypropane; a process wherein the amine is triethylamine, tripropylamine, 2-methyl-1,5-pentanediamine, 1,4-diaminobutane, 1,8-diaminooctane, 1,5-diaminopentane, 1,6-diaminohexane, 1,7-diaminoheptane, 1,3-diaminopropane, 1,2-diaminopropane, or 1,3-diamino-2-hydroxypropane; a process wherein the amine is an aliphatic amine; a process wherein the amine is 2-methyl-1,5-pentanediamine; and a process wherein the amine is 2-methyl-1,5-pentanediamine.

The preferred latex resin is a sulfonated polyester, specific examples of which include those as illustrated in the patent and copending applications mentioned herein, such as U.S. Ser. No. 221,595, the disclosure of which is totally incorporated herein by reference, such as a sodio sulfonated polyesters, and more specifically, a polyester, such as poly (1,2-propylene-sodio 5-sulfoisophthalate), poly (neopentylene-sodio 5-sulfoisophthalate), poly(diethylene-sodio 5-sulfoisophthalate), copoly(1,2-propylene-sodio 5-sulfoisophthalate)-copoly-(1,2-propylene-terephthalate phthalate), copoly(1,2-propylene-diethylene-sodio 5-sulfoisophthalate)-copoly-(1,2-propylene-diethylene-terephthalate-phthalate), copoly(ethylene-neopentylene-sodio 5-sulfoisophthalate)-copoly-(ethylene-neopentylene-terephthalate-phthalate), copoly(propoxylated bisphenol A)-copoly-(propoxylated bisphenol A-sodio 5-sulfoisophthalate) bisphenylene, bis(alkyloxy) bisphenolene, and the like. The sulfopolyester possesses, for example, a number average molecular weight ($M_n$) of from about 1,500 to about 50,000 grams per mole, a weight average molecular weight ($M_w$) of, for example, from about 6,000 grams per mole to about 150,000 grams per mole as measured by gel permeation chromatography and using polystyrene as standards.

Various known suitable colorants, such as pigments, present in the toner in an effective amount of, for example, from about 1 to about 25 percent by weight of the toner, and preferably in an amount of from about 2 to about 12 weight percent, include carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention. Other known colorants can be selected, reference the appropriate pigments, and dyes of the Color Index.

Colorant includes dyes, pigments, mixtures thereof, mixtures of pigments, mixtures of dyes, and the like.

Examples of specific amines selected for the processes of the present invention are ethanolamine, triethylamine, tripropylamine, 2-methyl-1,5-pentanediamine, 1,4-diaminobutane, 1,8-diaminooctane, 1,5-diaminopentane, 1,6-diaminohexane, 1,7-diaminoheptane, 1,3-diaminopropane, 1,2-diaminopropane, 1,3-diamino-2-hydroxypropane, and the like. The amines are selected in various suitable amounts, for example, in amounts of about 1 to about 10 weight percent and preferably about 2 to about 8 weight percent based on the total solids contents, wherein the solids are, for example, resin and colorant.

In the embodiments of the present invention, the amines function, it is believed, as coagulating or flocculating agents for the sulfonated polyester resin particles and submicron colorant particles stabilized by the submicron sulfonated polyester particles, and wherein there is enabled colorant, especially pigmented polyester particles with no, or substantially no crosslinking, and there results images with gloss units in excess of about 70 GGU, and more specifically, about 75 to about 90 GGU. The use of small organic molecules, such as an aliphatic amine, is of importance in obtaining toner size particles which exhibit noncrosslinking behavior often observed when divalent salts are used as coagulants, and wherein there results low gloss images of, for example, less than 70 GGU.

The toner may also include known charge additives in effective amounts of, for example, from 0.1 to 5 weight percent such as alkyl pyridinium amines, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, and the like.

Surface additives that can be preferably added to the toner compositions after washing or drying include, for example, metal salts, metal salts of fatty acids, colloidal silicas, titanium oxides, mixtures thereof and the like, which additives are each usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and silicas, available from Cabot Corporation and Degussa Chemicals like AEROSIL R972® available from Degussa, each in amounts of from 0.1 to 2, and which additives which can be added during the aggregation process or blended into the formed toner product.

Developer compositions can be prepared by mixing the toners obtained with the processes of the present invention with known carrier particles including coated carriers, such as steel, ferrites, and the like, reference U.S. Pat. Nos. 4,937,166 and 4,935,326, the disclosures of which are totally incorporated herein by reference, for example, from about 2 percent toner concentration to about 8 percent toner concentration. Also, for the developers there can be selected carrier particles with a core and a polymer thereover of, for example, polymethylmethacrylate with a conductive component, such as carbon black dispersed therein.

Imaging methods are also envisioned with the toners of the present invention, reference for example a number of the patents mentioned herein, and U.S. Pat. Nos. 4,265,660; 4,585,884; 4,584,253; and 4,563,408, the disclosures of which are totally incorporated herein by reference.

The following Examples are provided. These Examples are intended to be illustrative only and are not intended to limit the scope of the present invention. Also, parts and percentages are by weight and wherein the total of the solids is about 100 percent, unless otherwise indicated. Comparative Examples are also provided. All the tribo results reported were accomplished with a 65 micron steel core coated with 1 weight percent of polymethylmethacrylate unless otherwise specifically indicated.

PREPARATION OF SULFONATED POLYESTERS

Preparation of Linear Low Sulfonated Polyester GS722:

A linear sulfonated random copolyester resin comprised of, on a mol percent, 0.465 of terephthalate, 0.035 of sodium sulfoisophthalate, 0.475 of 1,2-propanediol, and 0.025 of diethylene glycol was prepared as follows. In a 5 gallon Parr reactor equipped with a bottom drain valve, double turbine agitator, and distillation receiver with a cold water condenser were charged 3.98 kilograms of dimethylterephthalate, 451 grams of sodium dimethyl sulfoisophthalate, 3.104 kilograms of 1,2-propanediol (1 mole excess of glycols), 351 grams of diethylene glycol (1 mole excess of glycols), and 8 grams of butyltin hydroxide oxide as the catalyst. The reactor was then heated to 165° C. with stirring for 3 hours whereby 1.33 kilograms of distillate were collected in the distillation receiver, and which distillate was comprised of about 98 percent by volume of methanol and 2 percent by volume of 1,2-propanediol as measured by the ABBE refractometer available from American Optical Corporation. The mixture was then heated to 190° C. over a one hour period, after which the pressure was slowly reduced from atmospheric pressure to about 260 Torr over a one hour period, and then reduced to 5 Torr over a two hour period with the collection of approximately 470 grams of distillate in the distillation receiver, and which distillate was comprised of approximately 97 percent by volume of 1,2-propanediol and 3 percent by volume of methanol as measured by the ABBE refractometer. The pressure was then further reduced to about 1 Torr over a 30 minute period whereby an additional 530 grams of 1,2-propanediol were collected. The reactor was then purged with nitrogen to atmospheric pressure, and the polymer product discharged through the bottom drain onto a container cooled with dry ice to yield 5.60 kilograms of 3.5 mol percent sulfonated polyester resin, copoly(1,2-propylene-diethylene) terephthalatecopoly(sodium sulfoisophthalate dicarboxylate). The sulfonated polyester resin glass transition temperature was measured to be 56.6° C. (onset) utilizing the 910 Differential Scanning Calorimeter available from E.I. DuPont operating at a heating rate of 10° C. per minute. The number average molecular weight was measured to be 3,250 grams per mole, and the weight average molecular weight was measured to be 5,290 grams per mole using tetrahydrofuran as the solvent.

Preparation of Latex Stock Solutions:

1,000 Grams of deionized water were heated to 65° C. (Centigrade throughout), after which 250 grams of the above prepared sulfonated polyester (GS722) were slowly introduced and heated for 1 hour at 65° C., until the polymer was fully dispersed. The latex had a characteristic blue tinge and was found to have a particle size of 35 nanometers (volume weighted) as measured using a Nicomp particle sizer. These stock solutions were found to be stable.

Preparation of Moderately Sulfonated Polyester Resin for Pigmented Dispersions (CN25):

A linear sulfonated random copolyester resin comprised of, on a mol percent, 0.425 of terephthalate, 0.075 of sodium sulfoisophthalate, 0.45 of 1,2-propanediol, and 0.025 of diethylene glycol was prepared as follows. In a 5 gallon Parr reactor equipped with a bottom drain valve, double turbine agitator, and distillation receiver with a cold water condenser were charged 3.50 kilograms of dimethylterephthalate, 940 grams of sodium dimethylsulfoisophthalate, 2.90 kilograms of 1,2-propanediol (1 mole excess of glycols), 449 grams of diethylene glycol (1 mole excess of glycols), and 7.2 gram of butyltin hydroxide oxide as the catalyst. The reactor was then heated to 165° C. with stirring for 3 hours, whereby 1.15 kilograms of distillate were collected in the distillation receiver, and which distillate was comprised of about 98 percent by volume of methanol and 2 percent by volume of 1,2-propanediol as measured by the ABBE refractometer available from American Optical Corporation. The mixture was then heated to 190° C. over a one hour period, after which the pressure was slowly reduced from atmospheric pressure to about 260 Torr over a one hour period, and then reduced to 5 Torr over a two hour period with the collection of approximately 320 grams of distillate in the distillation receiver, and which distillate was comprised of approximately 97 percent by volume of 1,2-propanediol and 3 percent by volume of methanol as measured by the ABBE refractometer. The pressure was then further reduced to about 1 Torr over a 30 minute period whereby an additional 60 grams of 1,2-propanediol were collected. The reactor was then purged with nitrogen to atmospheric pressure, and the polymer product discharged through the bottom drain onto a container cooled with dry ice to yield 6.1 kilograms of 7.5 mol percent sulfonated polyester resin, copoly(1,2-propylene-diethylene) terephthalate-copoly(sodium sulfoisophthalate dicarboxylate). The sulfonated polyester resin glass transition temperature was measured to be 57.0° C. (onset) utilizing the 910 Differential Scanning Calorimeter available from E.I. DuPont operating at a heating rate of 10° C. per minute. The number average molecular weight was measured to be 2,780 grams per mole, and the weight average molecular weight was measured to be 4,270 grams per mole, as measured on a Waters GPC using tetrahydrofuran as the solvent.

Preparation of the Submicron Polyester Dispersion:

One liter (1,000 milliliters) of the distilled water was first heated up to 70° C. (10° C. to 15° C. above the resin Tg), to which 200 grams of the above sulfonated polyester (CN25) wee slowly introduced while stirring until completely dispersed . The mean particle size as measured using a Nicomp particle size analyzer was found to be 20 nanometers, with a size range of 5 to 30 nanometers. The solids loading was 20 weight percent in water.

General Colorant Dispersion Synthesis:

To the above dispersion containing 20 weight percent of the submicron sulfonated resin dispersion was added a colorant, like a cyan wet cake of pigment containing 50 weight percent solids, and the mixture resulting was subjected to grinding to a stable colorant dispersion with an average particle size of between 50 to 120 nanometers. There resulted a dispersion with 30 weight percent colorant, 10 weight percent submicron resin particles, and 60 weight percent water. Similarly, a Yellow 180, Red 122, Red 238, Red 81.3 and carbon black REGAL 330® dispersions stabilized by polyester resin particles were prepared by Sun Chemicals, and these dispersions were then utilized in the toner synthesis.

EXAMPLE I

Toner Synthesis Cyan 15.3

50 Grams of sulfonated polyester resin GS722 were hydrodispersed in 200 grams of hot (55 to 65° C.) water. The particle size of the latex at this point was 35 nanometers (Nicomp Volume-Weighted Average). To this emulsion were added 5.85 grams of a cyan pigment dispersion wherein the pigment was stabilized by the submicron sulfonated polyester resin particles (as described above), and which pigment dispersion was comprised of 30 percent pigment, believed to be physically coated on the pigment, 10 percent sulfonated polyester, and 60 percent water. This mixture was polytroned and 2.5 grams of the amine Dytek, which is 2-methyl-1,5-pentanediamine, in 5 milliliters of water were added. This emulsion was then transferred into a 1 liter reaction kettle equipped with an overhead stirrer. The resulting mixture was heated with stirring to 52° C. After 4.5 hours, there resulted toner particles comprised of 96.25 weight percent of the sulfonated polyester resin and 3.75 weight percent of pigment, and which toner possessed a particle size of 6.7 microns in volume average diameter, and with a GSD of 1.18 as determined by a Coulter Counter. The resulting mixture was diluted with 2 liters of cold water and filtered. The filtrate was clear with no evidence of free pigment in the water phase. The toner charge at 20 percent RH was −21.1 μc/gram, and which charge was determined by the known Faraday Cage method throughout.

EXAMPLE II

Toner Synthesis Containing Red 81.3 (Magenta)

50 Grams of sulfonated polyester resin GS722 was hydrodispersed in 200 grams of hot (55° C. to 65° C.) water. The particle size of the latex at this point was 35 nanometers (Nicomp Volume Weighted Average). To this emulsion were added 8.3 grams of a magenta pigment dispersion wherein the pigment was stabilized by the submicron sulfonated polyester resin particles (as described above), and which dispersion was comprised of 30 percent pigment, Pigment Red 81.3, 10 percent sulfonated polyester and 60 percent water. This mixture was polytroned and 2.5 grams of Dytek (2-methyl-1,5-pentanediamine throughout) in 5 milliliters of water were added. This emulsion was then transferred into a 1 liter reaction kettle equipped with an overhead stirrer. The resulting mixture was heated with stirring to 52° C. After 4.5 hour, there resulted toner particles comprised of 95 weight percent of the sulfonated polyester resin and a GSD of 1.20. The mixture was diluted with 2 liters of cold water and filtered to remove any salts that may have been formed in the process. The filtrate was clear with no evidence of free pigment in the water phase and no evidence of free pigment in the water phase. The toner charge was −15.8 μc/gram at 20 percent RH as determined by the known Faraday Cage method.

EXAMPLE III

Toner Synthesis Containing Red 122 (Magenta)

50 Grams of sulfonated polyester resin GS722 were hydrodispersed in 200 grams of hot (55° C. to 65° C.) water. The particle size of the latex at this point was 35 nanometers (Nicomp Volume Weighted Average). To this emulsion were added 8.3 grams of a magenta pigment dispersion wherein the pigment was stabilized by the submicron sulfonated polyester resin particles (as described above), and which dispersion was comprised of 30 percent pigment, Pigment 122, 10 percent sulfonated polyester and 60 percent water. This mixture was polytroned and 2.5 grams of Dytek in 5 milliliters of water were added. The resulting emulsion was transferred into a 1 liter reaction kettle equipped with an overhead stirrer. The mixture was then heated with stirring to 52° C. After 4.5 hours, the particles comprising 95 weight percent of the sulfonated polyester resin and 5.0 weight percent of pigment were of a size of 6.2 microns with a GSD of 1.18. The mixture was then diluted with 1 liter of cold water and filtered to remove any salts that may have been formed in the process. The filtrate was clear with no evidence of free pigment in the water phase. The toner charge was −19.3 μc/gram at 20 percent RH.

EXAMPLE IV

Toner Synthesis Containing Red 238 (Magenta)

50 Grams of sulfonated polyester resin GS722 was hydrodispersed in 200 grams of hot (55 to 65° C.) water. The particle size of the latex at this point was 35 nanometers (Nicomp Volume Weighted Average). To this emulsion were added 8.3 grams of a magenta pigment dispersion wherein the pigment was stabilized by the submicron sulfonated polyester resin particles (as described above), and which dispersion was comprised of 30 percent pigment, Pigment 238, 10 percent sulfonated polyester and 60 percent water. This mixture was polytroned and 2.5 grams of Dytek in 5 milliliters of water were added. The resulting emulsion was transferred into a 1 liter reaction kettle equipped with an overhead stirrer. The mixture was then heated with stirring to 54° C. After 4.5 hours, the particles were comprised of 95 weight percent of the sulfonated polyester resin and 5.0 weight percent of pigment, and which toner possessed a size of 6.7 microns and a GSD of 1.17. The mixture was then diluted with 1 liter of cold water and filtered to remove any salts that may have been formed in the process. The filtrate was clear with no evidence of free pigment in the water phase. The toner charge was 22.3 μc/gram at 20 percent RH.

EXAMPLE V

Toner Synthesis Containing Red 122/238 (Magenta)

50 Grams of sulfonated polyester resin GS722 was hydrodispersed in 200 grams of hot (55° C. to 65° C.) water. The particle size of the latex at this point was 35 nanometers (Nicomp Volume Weighted Average). To this emulsion were added 8.3 grams of a magenta pigment dispersion containing a mixture of 4.98 grams of Red 122 and 3.32 grams of Red 238 dispersion, wherein the pigment for both dispersions was stabilized by the submicron sulfonated polyester resin particles (as described above), and which dispersions were comprised of 30 percent pigment, 10 percent sulfonated polyester and 60 percent water. This mixture was polytroned and 2.5 grams of Dytek in 5 milliliters of water were added. The resulting emulsion was transferred into a 1 liter reaction kettle equipped with an overhead stirrer. The mixture was then heated with stirring to 54° C. After 4.5 hours, there resulted particles comprised of 95 weight percent of the sulfonated polyester resin and 5.0 weight percent of pigment, and which toner had a size of 7.0 microns and a GSD of 1.17. The resulting mixture was diluted with 1 liter of cold water and filtered to remove any salts that may have been formed in the process. The filtrate was clear with no evidence of free pigment in the water phase. The toner charge was −20.1 μc/gram at 20 percent RH.

EXAMPLE VI

Toner Synthesis Containing REGAL 330® (Black)

50 Grams of sulfonated polyester resin GS722 were hydrodispersed in 200 grams of hot (55° C. to 65° C.) water. The particle size of the latex at this point was 35 nanometers (Nicomp Volume Weighted Average). To this emulsion were added 10.0 grams of a black pigment dispersion wherein the pigment was stabilized by the submicron sulfonated polyester resin particles (as described above), and which dispersion was comprised of 30 percent of the pigment, carbon black REGAL 330™, 10 percent sulfonated polyester and 60 percent water. This mixture was polytroned and 2.5 grams of Dytek in 5 milliliters of water were added. The resulting emulsion was transferred into a 1 liter reaction kettle equipped with an overhead stirrer. The mixture was then heated with stirring to 54° C. After 4.5 hours, the particles comprising 94 weight percent copoly(1,2-propylene-diethylene-sodio 5-sulfoisophthalate)-copoly-(1,2-propylene-diethylene-terephthalate-phthalate) sulfonated polyester resin and 6.0 weight percent of pigment possessed a size of 6.8 microns with a GSD of 1.18. The mixture was diluted with 1 liter of cold water and filtered to remove any salts that may have been formed in the process. The filtrate was clear with no evidence of free pigment in the water phase. The toner charge was −13.7 μc/grm at 20 percent RH.

EXAMPLE VII

Toner Synthesis Containing Yellow 180

50 Grams of sulfonated polyester resin GS722 were hydrodispersed in 200 grams of hot (55° C. to 65° C.) water. The particle size of the latex at this point was 35 nanometers (Nicomp Volume Weighted Average). To this emulsion were added 13.5 grams of a black pigment dispersion wherein the pigment was stabilized by the submicron sulfonated polyester (copoly-(1,2-propylene-diethylene-sodio 5-sulfoisophthalate)-copoly-(1,2-propylene-diethylene-terephthalate-phthalate-throughout) resin particles (as described above, and which dispersion was comprised of 30 percent pigment, pigment Yellow 180, 10 percent sulfonated polyester and 60 percent water. This mixture was polytroned and 2.5 grams of Dytek in 5 milliliters of water were added. The resulting emulsion was transferred into a 1 liter reaction kettle equipped with an overhead stirrer. The mixture was then heated with stirring to 52° C. After 4.5 hours, the particles comprising 92 weight percent sulfonated polyester resin, and 8.0 weight percent of the above pigment were of a size of 6.75 microns and had a GSD of 1.18. The mixture was diluted with 1 liter of cold water and filtered to remove any salts that may have been formed in the process. The filtrate was clear with no evidence of free pigment in the water phase. The toner charge was −22.1 μc/gram at 20 percent RH.

The above toners, when used in, for example, the Xerox Corporation 5090, enabled high gloss images with a gloss of about 80 to 85 GGU (Gardner Gloss Units) as measured by Gardner Gloss meter matching of toner and paper. This contrasted with a gloss of less than about 70 for toners prepared with salts as illustrated in the prior art U.S. Pat. No. 5,593,807.

The following two Comparative Examples 1 and 2 illustrate that using a surfactant stabilized pigment in the formulation results in very little change in the charging properties, but exhibits continuous bleeding of dye/pigment as the toner particles were washed

COMPARATIVE EXAMPLE 1

Toner Synthesis Containing Red 81.3 (Magenta)

50 Grams of sulfonated polyester resin GS722 were hydrodispersed in 200 grams of hot (55° C. to 65° C.) water. The particle size of the latex at this point was 35 nanometers (Nicomp Volume Weighted Average). To this emulsion were added 12 grams of Red 81:3 pigment dispersion wherein the pigment was prepared from a laked RHODAMINE dye, and wherein the pigment was stabilized with a Sulfonyl GA nonionic surfactant and had a pigment loading of 21 weight percent and 60 percent water. This mixture was polytroned and 75 milliliters of a 1 percent magnesium chloride solution in water were slowly added over a period of 20 minutes. The resulting emulsion was transferred into a 1 liter reaction kettle equipped with an overhead stirrer. The mixture was heated with stirring to 52° C. After 6.5 hours, there resulted particles comprised of 95 weight percent sulfonated polyester resin and 5.0 weight percent of pigment, and which toner was of a size of 7.1 microns with a GSD of 1.20. The mixture was diluted with 2 liters of cold water and filtered to remove any salts that may have formed, and also to remove the surfactant that was employed to stabilize the pigment. The filtrate had a fluorescent RHODAMINE™ dye in the water phase and upon further washing continued to bleed into the aqueous phase. The toner particles were washed a total of 4 times with deionized water. The toner charge was −11.7 μc/gram at 20 percent RH.

COMPARATIVE EXAMPLE 2

Toner Synthesis Containing Cyan 15.3

50 Grams of sulfonated polyester resin GS722 were hydrodispersed in 200 grams of hot (55° C. to 65° C.) water. The particle size of the latex at this point was 35 nanometers (Nicomp Volume Weighted Average). To this emulsion were added 3.5 grams of a cyan pigment dispersion wherein the pigment was stabilized with a Sulfonyl GA nonionic surfactant and had a pigment loading of 53.4 weight percent and 60 percent water. This mixture was polytroned and 75 milliliters of a 1 percent magnesium chloride solution in water were slowly added over a period of 20 minutes. The resulting emulsion was transferred into a 1 liter reaction kettle equipped with an overhead stirrer. The mixture was heated with stirring to 54° C. After 5.5 hours, there resulted particles comprised of 96.25 weight percent sulfonated polyester resin and 3.75 weight percent of the pigment Blue 15:3, and which toner had a size of 7.1 microns with a GSD of 1.20. The mixture was diluted with 2 liters of cold water and filtered to remove any salts that may have formed, and also to remove the surfactant that was employed to stabilize the pigment. The filtrate was blue in color indicating lack of full incorporation of the pigment in the toner, and upon further washing the color intensity of the filtrate kept on reducing. The toner particles were washed a total of 5 times with deionized water. The toner charge was −16.7 μc/gram at 20 percent RH.

Preparation Of Latex B-Sty/BA/AA (82/18/2 pph):

An anionic polymeric latex was prepared by the emulsion polymerization of styrene/butylacrylate/acrylic acid (82/18/2) in a nonionic/anionic surfactant solution (1 percent/0.9 percent) as follows. 451 Grams of styrene, 99 grams of butylacrylate, 11 grams of acrylic acid, 10.06 grams of dodecanethiol, and 5.5 grams of carbon tetrabromide were mixed with 825 milliliters of deionized water in which 12.38 grams of sodium dodecyl benzene sulfonate anionic surfactant (NEOGEN R™ which contains 60 percent of active component), 11.82 grams of polyoxyethylene tetramethyl butyl phenyl ether nonionic surfactant (ANTAROX CA897™—70 percent active component), and 5.5 grams of ammonium persulfate initiator were dissolved. The emulsion resulting was then polymerized in a nitrogen atmosphere at 70° C. for 6 hours with a stirring rate of 650 rpm. The resulting latex contained 60 percent of water and 40 percent of solids primarily of polystyrene/polybutylacrylate/polyacrylic acid 82/18/2 resin; the $T_g$ of the latex dry sample was 65.0° C.; $M_w$=27,000, and $M_n$=8,000; and particle size was 195 nanometers.

The following two Comparative Examples 3 and 4 illustrate that bleeding of the dye/pigment continues although the resin and the coagulant are different. Pigment particles, when stabilized by submicron sulfonated polyester particles or other submicron resin particles, such as styrene acrylic acids, eliminates pigment bleeding when the toner particles are washed, and hence the waste water can be directly discharged into the sewer without additional treatments.

COMPARATIVE EXAMPLE 3

Preparation of a Magenta Toner (Red 81:3):

260 Grams of anionic Latex B, prepared above, (40 percent solids) were simultaneously added with a 170 grams of pigment solution comprised of 18 grams of the Red 81:3 pigment dispersion wherein the pigment was prepared from a laked RHODAMINE™ dye, and wherein the pigment was stabilized by the sulfonated polyester submicron resin particles and not a surfactant stabilized dispersion, and 152 grams of water to 400 grams of water while being polytroned at speeds of 5,000 rpm for a duration of 3 minutes. 2.4 Grams of cationic surfactant (SANIZOL B™) were dispersed in 30 grams of water and added to the above mixture while being polytroned. The viscous mixture comprising red pigment and latex particles was then transferred into a reaction kettle and its temperature raised to 48° C. (approximately 5 to 7 degrees below the resin Tg) to perform the aggregation. The particle size was monitored during the aggregation process. After about 20 minutes, the size was 5.7 microns and the grams SD was 1.18. 45 Milliliters of 20 percent (by weight) of anionic surfactant solution were added to the aggregates, followed by further raising the temperature to 95° C. for a period of 4 hours. The particles resulting were comprised of 95 weight percent of resin and 5 weight percent of pigment of Red 81:3, and the toner size was 6.3 microns with a GSD of 1.20. The morphology of the particle was potato like. The reactor contents were allowed to cool down to room temperature and was were through a 3 μm filter. The effluent showed signs of fluorescent RHODAMINE™ dye present in the aqueous phase of the first filtrate. Subsequent washing and filtration steps showed an absence of the fluorescent RHODAMINE™ dye in the aqueous phase as opposed to when the surfactant stabilizer dispersions were used, wherein the fluorescent RHODAMINE™ dye was bleeding continuously. The disadvantage of bleeding is that the filtrate has to be further treated in order to remove the colorant from before disposal. This treatment would add to the cost of the toner manufacturing cost. The toner particles were washed 6 times with deionized water, and dried. The toner charge was −16.8 μc/gram at 20 percent RH.

COMPARATIVE EXAMPLE 4

Preparation of a Magenta Toner (Red 81:3):

260 Grams of anionic Latex B (40 percent solids) were simultaneously added with 170 grams of pigment solution comprised of 25 grams of the Red 81:3 pigment dispersion, and wherein the pigment was prepared from a laked RHODAMINE™ dye, and wherein the pigment solids loading was 21 percent, and wherein the pigment was stabilized by a nonionic surfactant and 145 grams of water to 400 grams of water while being polytroned at speeds of 5,000 rpm for a duration of 3 minutes. 2.4 Grams of cationic surfactant (SANIZOL B™) were dispersed in 30 grams of water and added to the above mixture while being polytroned. The viscous mixture comprised of pigment and latex particles was then transferred into a reaction kettle and its temperature raised to 48° C. (approximately 5 to 7 degrees below the resin Tg) to perform the aggregation. The particle size was monitored during the aggregation process. After about 20 minutes, the size was 5.7 microns and the GSD was 1.18. 45 Milliliters of 20 percent (by weight) of anionic surfactant solution were added to the aggregates, followed by further raising the temperature to 95° C. for a period of 4 hours. The resulting particles were comprised of 95 weight percent sulfonated polyester resin and 5 weight percent of pigment, and the toner particles were of a size of 6.3 microns with a GSD of 1.20. The morphology of the particle was potato like. The reactor contents were allowed to cool down to room temperature and were filtered through a 3 μm filter. The effluent showed signs of fluorescent RHODAMINE™ dye present in the aqueous phase. Subsequent washing and filtration steps showed presence of the fluorescent RHODAMINE™ dye in the aqueous phase as opposed to when the pigment stabilized dispersions were used. The toner charge was −13.8 μc/gram at 20 percent RH.

Other embodiments and modifications of the present invention may occur to those of ordinary skill in the art subsequent to a review of the present application and the information presented herein; these embodiments modifications, and equivalents, or substantial equivalents thereof, are also included within the scope of this invention.

What is claimed is:

1. A process for the preparation of toner comprising mixing an amine, an emulsion latex containing sulfonated polyester resin, and a colorant dispersion, heating the resulting mixture, and optionally cooling.

2. A process in accordance with claim 1 wherein said latex contains water and suspended therein a sodio sulfonated polyester resin of from about 5 to about 500 nanometers in size diameter, wherein said colorant is stabilized by submicron sodio sulfonated polyester resin, and thereafter adding to the mixture an amine, and wherein cooling is accomplished.

3. A process in accordance with claim 2 wherein said (i) sodio sulfonated polyester resin is prepared by heating said resin in water at a temperature of from about 65° C. to about 90° C.; (ii) thereafter adding said colorant dispersion, wherein the colorant dispersion is stabilized by said submicron sodio sulfonated polyester resin particles, to said latex mixture with shearing, followed by the addition of said amine and water until there results an increase in the latex viscosity of from about 2 centipoise to about 100 centipoise, cooling, and heating the resulting mixture at a temperature of from about 45° C. to about 80° C. thereby enabling continuous aggregation and coalescence of particles of resin and colorant, resulting in toner particles of from about 2 to about 20 microns in volume average diameter; and (iii) quenching, or cooling the product mixture followed by filtration and drying.

4. A process in accordance with claim 3 the colorant dispersion contains a pigment, and wherein the pigment is stabilized by said submicron sodio sulfonated polyester resin, and which resin is in the size range of from about 50 to about 250 nanometers, and wherein said shearing in (ii) is completed by homogenizing at from about 1,000 revolutions per minute to about 10,000 revolutions per minute, at a temperature of from about 25° C. to about 35° C., and for a duration of from about 1 minute to about 120 minutes.

5. A process in accordance with claim 3 wherein the dispersion of (ii) is accomplished by microfluidization in a microfluidizer, or in nanojet for a duration of from about 1 minute to about 120 minutes.

6. A process in accordance with claim 3 wherein shearing or homogenization is accomplished by homogenizing at from about 1,000 revolutions per minute to about 10,000 revolutions per minute for a duration of from about 1 minute to about 120 minutes.

7. A process in accordance with claim 1 wherein the resin is (i) a polyester of poly(1,2-propylene-sodio 5-sulfoisophthalate), poly(neopentylene-sodio 5-sulfoisophthalate), poly(diethylene-sodio 5-sulfoisophthalate), copoly(1,2-propylene-sodio 5-sulfoisophthalate)-copoly-(1,2-propylene-terephthalatephthalate), copoly(1,2-propylene-diethylene sodio 5-sulfoisophthalate)-copoly-(1,2-propylene-diethylene-terephthalatephthalate), copoly(ethylene-neopentylene-sodio 5-sulfoisophthalate)-copoly-(ethylene-neopentylene-terephthalatephthalate), or copoly (propoxylated bisphenol A)-copoly-(propoxylated bisphenol A-sodio 5-sulfoisophthalate).

8. A process in accordance with claim 3 wherein the resin of (i) is a polyester of poly(1,2-propylene-sodio 5-sulfoisophthalate), poly(neopentylene-sodio 5-sulfoisophthalate), poly(diethylene-sodio 5-sulfoisophthalate), copoly(1,2-propylene-sodio 5-sulfoisophthalate)-copoly-(1,2-propylene-terephthalatephthalate), copoly(1,2-propylene-diethylene sodio 5-sulfoisophthalate)-copoly-(1,2-propylene-diethylene-terephthalatephthalate), copoly(ethylene-neopentylene-sodio 5-sulfoisophthalate)-copoly-(ethylene-neopentylene-terephthalatephthalate), or copoly (propoxylated bisphenol A)-copoly-(propoxylated bisphenol A-sodio 5-sulfoisophthalate).

9. A process in accordance with claim 2 wherein the colorant is carbon black, cyan, yellow, magenta, and mixtures thereof.

10. A process in accordance with claim 2 wherein the resin utilized is from about 0.01 to about 0.2 micron in volume average diameter, and the colorant particles are from about 0.01 to about 500 nanometers in volume average diameter.

11. A process in accordance with claim 2 wherein the toner particles isolated are from about 2 to about 15 microns in volume average diameter, and the geometric size distribution thereof is from about 1.15 to about 1.35.

12. A process in accordance with claim 2 wherein there is added to the surface of the formed toner metal salts, metal salts of fatty acids, silicas, metal oxides, or mixtures thereof, each in an amount of from about 0.1 to about 10 weight percent of the obtained toner particles.

13. A process in accordance with claim 2 wherein the toner obtained after cooling is from about 3 to about 15 microns in volume average diameter, and the geometric size distribution thereof is from about 1.15 to about 1.30.

14. A process in accordance with claim 3 wherein resin Tg is from about 50° C. to about 65° C.

15. A surfactant free process for the preparation of toner, and which process comprises providing, or generating an emulsion latex comprised of sodio sulfonated polyester resin particles of less than about 0.2 micron in size diameter by heating said resin in water at a temperature of from about 15° C. to about 30° C. above the resin glass transition temperature; mixing with a colorant dispersion wherein the dispersion is comprised of colorant and submicron sodio sulfonated resin particles of a size less than about 0.2 micron and which resin particles are coated on the colorant; followed by the addition of an amine of from about 1 to about 2 weight percent in water until a slight increase in viscosity of from about 2 centipoise to about 100 centipoise results; heating the resulting mixture at a temperature of from about 45° C. to about 80° C. thereby enabling aggregation and coalescence of particles of resin and colorant in a continuous manner, resulting in toner particles of from about 2 to about 20 microns in volume average diameter, and thereafter cooling the product mixture, followed by washing and drying.

16. A process for the preparation of toner comprising mixing an emulsion latex comprised of sodio sulfonated polyester resin particles and a colorant dispersion, and wherein the colorant is of submicron size and is stabilized by submicron resin particles, followed by the addition of an amine; and heating the resulting mixture thereby causing aggregation and coalescence.

17. A process in accordance with claim 16 wherein subsequent to coalescence the toner product mixture is cooled, followed by isolation, washing and drying.

18. A process in accordance with claim 16 wherein the toner product mixture is cooled to about 25° C.

19. A process in accordance with claim 3 wherein in (ii) the colorant dispersion is generated with a microfluidizer at from about 75° C. to about 85° C. for a duration of from about 1 hour to about 3 hours, and wherein subsequent to (iv) the toner compositions or particles resulting are (v) cooled to about 25° C., followed by washing and drying.

20. A process in accordance with claim 2 wherein the amine is present in an amount of about 1 to about 10 weight percent based on the total solids.

21. A process in accordance with claim 1 wherein the amine is triethylamine, tripropylamine, 2-methyl-1,5-pentanediamine, 1,4-diaminobutane, 1,8-diaminooctane, 1,5-diaminopentane, 1,6-diaminohexane, 1,7-diaminoheptane, 1,3-diaminopropane, 1,2-diaminopropane, or 1,3-diamino-2-hydroxypropane.

22. A process in accordance with claim 2 wherein the amine is triethylamine, tripropylamine, 2-methyl-1,5-pentanediamine, 1,4-diaminobutane, 1,8-diaminooctane, 1,5-diaminopentane, 1,6-diaminohexane, 1,7-diaminoheptane, 1,3-diaminopropane, 1,2-diaminopropane, or 1,3-diamino-2-hydroxypropane.

23. A process in accordance with claim 1 wherein the amine is an aliphatic amine.

24. A process in accordance with claim 1 wherein the amine is 2-methyl-1,5-pentanediamine.

25. A process in accordance with claim 3 wherein the amine is 2-methyl-1,5-pentanediamine.

26. A process in accordance with claim 1 wherein the amine is selected in an amount of from about 0.5 to about 5 weight percent.

27. A process in accordance with claim 1 wherein the amine is selected in an amount of from about 1 to about 3 weight percent.

28. A surfactant free process for the preparation of toner, which process comprises admixing an amine, an emulsion latex containing a sulfonated polyester resin and a colorant dispersion, heating the resulting components, and optionally cooling.

29. A process in accordance with claim 28 wherein cooling is accomplished.

30. A process in accordance with claim 28 wherein the amine is an aliphatic amine.

31. A process in accordance with claim 28 wherein the amine is triethylamine, tripropylamine, 2-methyl-1,5-pentanediamine, 1,4-diaminobutane, 1,8-diaminooctane, 1,5-diaminopentane, 1,6-diaminohexane, 1,7-diaminoheptane, 1,3-diaminopropane, 1,2-diaminopropane, or 1,3-diamino-2-hydroxypropane.

32. A process in accordance with claim 28 wherein the amine is 2-methyl-1,5-pentanediamine.

* * * * *